US011691160B2

(12) United States Patent
Özdemir

(10) Patent No.: US 11,691,160 B2
(45) Date of Patent: Jul. 4, 2023

(54) AIR JIGGING MACHINE HAVING A PRESSURE MEASURING DEVICE

(71) Applicant: Allmineral Aufbereitungstechnik GmbH & Co. KG, Düsseldorf (DE)

(72) Inventor: Hakan Özdemir, Bühl (DE)

(73) Assignee: Allmineral Aufbereitungstechnik GmbH & Co. KG, Düsseldorf (DE)

( * ) Notice: Subject to any disclaimer, the term of this patent is extended or adjusted under 35 U.S.C. 154(b) by 40 days.

(21) Appl. No.: 17/424,820

(22) PCT Filed: Jan. 3, 2020

(86) PCT No.: PCT/EP2020/050069
§ 371 (c)(1),
(2) Date: Jul. 21, 2021

(87) PCT Pub. No.: WO2020/151931
PCT Pub. Date: Jul. 30, 2020

(65) Prior Publication Data

US 2022/0134352 A1 May 5, 2022

(30) Foreign Application Priority Data

Jan. 25, 2019 (DE) ..... 102019101908.7

(51) Int. Cl.
*B03B 4/00* (2006.01)
*B03B 4/02* (2006.01)
(Continued)

(52) U.S. Cl.
CPC ..... *B03B 4/005* (2013.01); *B03B 4/02* (2013.01); *B03B 11/00* (2013.01); *B03B 13/00* (2013.01)

(58) Field of Classification Search
CPC .. B03B 4/00; B03B 4/005; B03B 4/02; B03B 11/00; B03B 13/00
See application file for complete search history.

(56) References Cited

U.S. PATENT DOCUMENTS 5,087,351 A 2/1992 Valentine, Sr.
5,943,231 A 8/1999 Thomas
(Continued)

FOREIGN PATENT DOCUMENTS

CN 2796840 Y 7/2006
CN 2796841 Y 7/2006
(Continued)

OTHER PUBLICATIONS

English Translation of DE 2143817 (Year: 1973).*
(Continued)

*Primary Examiner* — Michael McCullough
*Assistant Examiner* — Jessica L Burkman
(74) *Attorney, Agent, or Firm* — Calfee, Halter & Griswold LLP

(57) ABSTRACT

The present invention relates to an air jigging machine for the dry processing of raw materials, particularly coal, comprising at least one material feeding device (1), at least one jigging material carrier (2), which is provided with openings, an air funnel (3), which is arranged below the jigging material carrier (2) and by means of which an air flow can be fed as working air (4) to the jigging material carrier, which working air is composed of a partial flow constantly flowing through the jigging material carrier (2) and a pulsing partial flow superposed thereon, such that the working air (4) can flow through the material fed onto the jigging material carrier (2) and said material can be stratified into a heavy material layer (5) acting as a jig bed and into a light material layer (6) lying thereon, and (Continued)

a discharge device (7) for the heavy material and light material stratified on the jigging material carrier (2) during the jigging process.

10 Claims, 1 Drawing Sheet

(51) Int. Cl.
*B03B 11/00* (2006.01)
*B03B 13/00* (2006.01)

(56) References Cited

U.S. PATENT DOCUMENTS

| | | | | |
|---|---|---|---|---|
| 9,561,510 | B2 * | 2/2017 | Snoby | B03B 4/005 |
| 2016/0354789 | A1 | 12/2016 | Snoby | |
| 2018/0280991 | A1 * | 10/2018 | Higuchi | C22B 23/005 |

FOREIGN PATENT DOCUMENTS

| | | | |
|---|---|---|---|
| CN | 108187897 | A | 6/2018 |
| DE | 2143817 | A1 | 3/1973 |
| EP | 0517022 | A2 | 12/1992 |
| RU | 2047376 | C1 | 11/1995 |
| WO | 2020151931 | A1 | 7/2020 |

OTHER PUBLICATIONS

"International Search Report for PCT Patent Application No. PCT/EP2020/050069", dated Mar. 12, 2020, 4 Pages.
"Written Opinion of the International Searching Authority for PCT Patent Application No. PCT/EP2020/050069", dated Mar. 12, 2020, 7 Pages.
"Office Action for Chinese Patent Application No. 202080010642.3", dated Nov. 2, 2022, 6 pages.

* cited by examiner

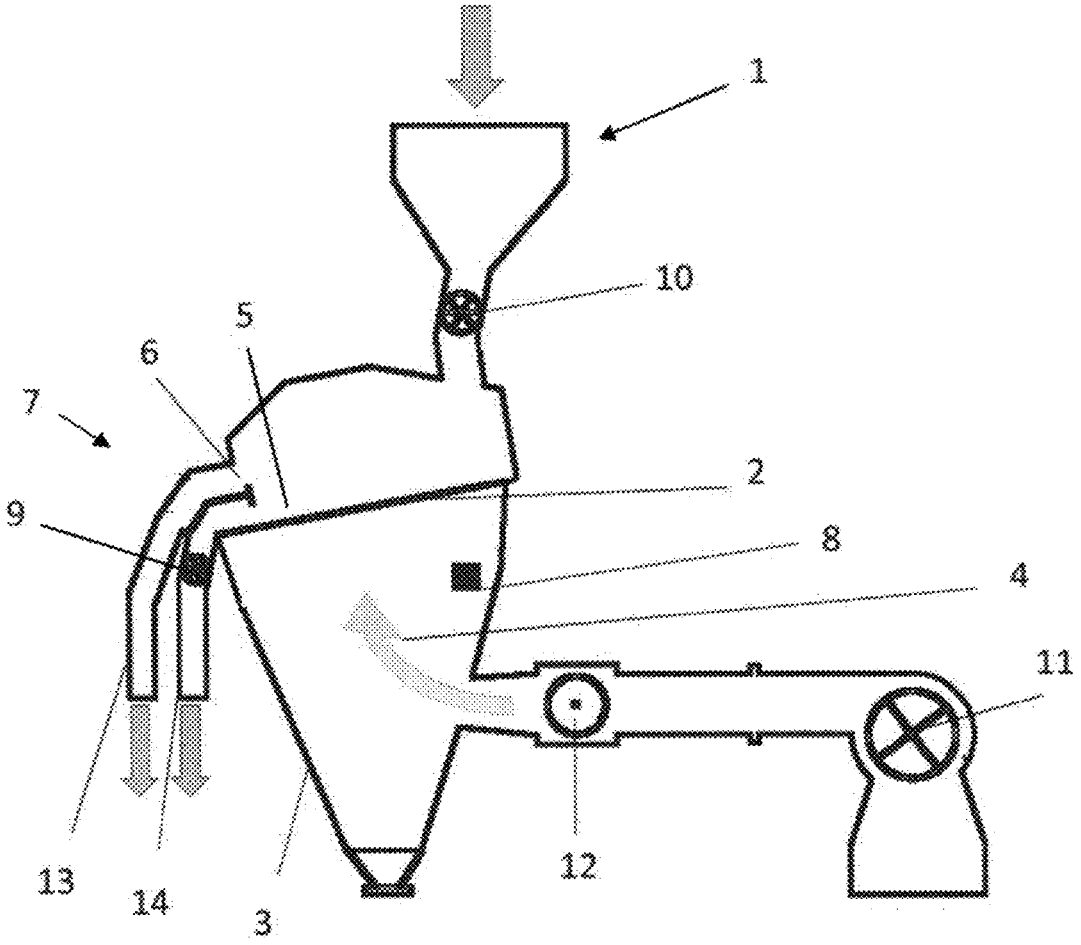
1
10
5
6
7
2
9
8
4
11
13
14
3
12

AIR JIGGING MACHINE HAVING A PRESSURE MEASURING DEVICE

The present invention pertains to an air jigging machine for dry processing of raw materials, particularly coal, wherein said air jigging machine comprises at least one material feeding device, at least one jigging material carrier that is provided with openings, an air funnel that is arranged underneath the jigging material carrier and by means of which an air flow can be fed to the jigging material carrier as working air, which is composed of a partial flow that constantly flows through the jigging material carrier and a superimposed partial flow that flows through the jigging material carrier in a pulsating manner, such that the working air can flow through the material fed onto the jigging material carrier and said material can be stratified into a heavy material layer acting as a jig bed and a light material layer lying thereon, as well as a discharge device for the heavy material and light material stratified on the jigging material carrier during the jigging process. The invention furthermore pertains to a method for operating an air jigging machine, in which material comprising light material and heavy material is fed onto at least one jigging material carrier that is provided with openings, in which an air flow flows through the material fed onto the jigging material carrier as working air, which is composed of a constant partial flow and a superimposed pulsating partial flow, such that the supplied material can be stratified into a heavy material layer acting as a jig bed and a light material layer lying thereon, and in which the stratified heavy material and light material are discharged.

An air jigging machine and a method for operating such an air jigging machine are known from EP 2 558 215 B1. In this case, the discharge rate of the stratified heavy material from the air jigging machine is adjusted by means of a rotary valve arranged in the discharge shaft for the heavy material. Furthermore, the jig bed density is determined by means of gamma radiation at the end of the jigging material carrier between the inlet into the heavy material shaft and the light material overflow arranged on top thereof in order to respectively control or regulate the rotary valve. The gamma radiation source and the detector for the gamma radiation weakened by the jig bed are arranged on opposite sides of the jigging material carrier such that the jig bed is penetrated by the gamma radiation over its width. The disadvantages of using such a measuring device, which operates based on gamma radiation, for determining the jig bed density are the required official permit for operating the measuring device, the high acquisition costs and the required training of the operating personnel, which may also be subjected to radiation exposure. In addition, gamma radiation only makes it possible to reliably determine the jig bed density of a jig bed with a maximum width of approximately 1.2 m.

EP 0 517 022 A1 discloses an air-assisted separator, in which the air pressure is regulated.

The present invention therefore is based on the objective of eliminating the disadvantages described with reference to the prior art and, in particular, of disclosing an air jigging machine and a method for operating an air jigging machine that make it possible to reduce the equipment expenditure and also allow the use of a jigging material carrier with greater width.

This objective is attained by means of an air jigging machine and a method with the features of the respective independent claim. Advantageous embodiments of the air jigging machine and the method are disclosed in the dependent claims and in the description, wherein individual features of the advantageous embodiments can be arbitrarily combined with one another in a technically sensible manner. In this respect, the features and advantages disclosed with reference to the method particularly can be applied to the air jigging machine and vise versa.

The above-defined objective is particularly solved by means of an air jigging machine with the initially cited features, in which a pressure measuring device for determining the pressure differential between the pressure in the air funnel and the surroundings is arranged upstream of (i.e. essentially underneath) the jigging material carrier. Such a pressure measuring device makes it possible to determine/measure the (working air) pressure underneath the jigging material carrier such that the infeed and/or preferably the discharge can be adjusted and preferably regulated in dependence on the determined/measured pressure. The pressure can be deduced at any location between the fan and the jig bed. Accordingly, the pressure measuring device can be arranged at a suitable location upstream of the jigging material carrier with reference to the flow direction of the air flow.

The invention is based on the realization that the counterpressure in the air funnel and therefore also the measured pressure differential in a chamber underneath the jigging material carrier increases as the height of the jigging material layer increases, wherein the pressure profile in dependence on the height of the jigging material layer corresponds to the profile of the density measurement in dependence on the height of the jigging material layer such that it is possible to forgo a measuring device for determining the density of the jig bed at the end of the jigging material carrier in order to determine the height of the jigging material layer. However, this not only makes it possible to eliminate the gamma radiation source, but also to use jigging material carriers with greater width, such that the throughput of the air jigging machine can be increased. Consequently, the at least one jigging material carrier preferably has a width of at least 2 m [meters], preferably at least 3 m or even at least 4 m.

The material feeding device comprises at least one infeed funnel, wherein an infeed shaft leads from the infeed funnel to an upper beginning of the jigging material carrier, which particularly is arranged in an inclined manner. The material feeding device particularly feeds the material over the entire width of the jigging material carrier. An infeed adjusting device such as a rotary gate valve preferably is arranged in the infeed shaft in order to adjust the quantity of the material being fed onto the jigging material carrier.

The jigging material carrier particularly is arranged in an inclined manner from its beginning associated with the material feeding device to its end associated with the discharge device. The jigging material carrier may be subjected to vibrations by means of an associated drive. For example, the drive may be realized in the form of an unbalance motor that causes the jigging material carrier to oscillate.

A device for generating the working air particularly is connected to the air funnel, wherein the device comprises a fan and/or a valve. In this case, the valve particularly is designed in such a way that the process air, which is generated by a fan in the form of an intermediate-pressure fan, is converted into working air that comprises two pulsations and a constant air flow. During the operation, the material being fed onto the jigging material carrier is lifted by the working air flowing through the jigging material carrier for a few milliseconds. During the subsequent jigging process, particles with higher density are accumulated on the jigging material carrier on the bottom whereas particles with lower density (coal) form the upper (light material) layer.

The discharge device arranged at the end of the jigging material carrier particularly has a discharge shaft for the heavy material, wherein a discharge adjusting device such as a rotary valve is arranged in this heavy material discharge shaft in order to adjust the discharge rate of the heavy material. A light material overflow, by means of which the light material is discharged from the jigging material carrier, is formed at the end of the jigging material carrier above the heavy material discharge shaft. A maximum height of the jig bed on the jigging material carrier is also predefined by the light material overflow and therefore known.

The air jigging machine preferably comprises a control unit for adjusting the material throughput, which can be influenced by the discharge adjusting device and/or the infeed adjusting device. The measured pressure differential is therefore used for a closed loop control or an open loop control of the material throughput.

For example, a discharge capacity of a discharge adjusting device of the discharge device for the heavy material may be adjusted, particularly regulated (with closed loop), in dependence on the measured pressure or the measured pressure differential, respectively.

In addition, the respective delivery rate or throughput of an infeed adjusting device of the material feeding device could also be adjusted (e.g. controlled or regulated) in dependence on the measured pressure differential or the measured pressure, respectively.

The pressure measuring device can also be used for determining an ideal operating point of the air flow, i.e. for calibration purposes, in that the air flow is changed between a minimal air flow and a maximal (particularly constant) air flow while the jigging material carrier is completely filled and the thusly measured pressure is used for adjusting an operating point of the working air. During such a calibration, the measured pressure initially increases as the air flow increases until the jig bed reaches a loosening or fluidizing point, at which the measured pressure abruptly drops. Starting at this loosening point, the measured pressure remains nearly constant as the air flow increases until the power is so high that the pneumatic conveyance takes effect. The thusly measured pressure profile can be used for adjusting the ideal operating point.

The invention and the technical background are described in an exemplary manner below with reference to the exemplary embodiment schematically illustrated in the FIGURE.

The air jigging machine illustrated in the FIGURE comprises a material feeding device 1 with an infeed adjusting device 10 in the form of a rotary valve, by means of which the material being introduced into the material feeding device is fed to a jigging material carrier 2. The jigging material carrier 2 is arranged in an inclined manner and has multiple openings such that working air 4 can flow through the jigging material carrier 2 from below. A fan 11 and a valve 12 arranged downstream of the fan 11 serve for introducing the working air into an air funnel 3. In this case, the working air being supplied via the air funnel 3 arranged underneath the jigging material carrier 2 is composed of a constant partial flow and a superimposed pulsating partial flow. During the operation, this working air causes the material on the jigging material carrier 2 to be stratified into a lower heavy material layer 5 and an upper light material layer 6.

A discharge device 7 is arranged at the end of the jigging material carrier 2 and has a heavy material shaft 14, as well as a light material overflow 13 arranged at the end of the jigging material carrier 2 above the heavy material shaft 14. A discharge adjusting device 9 in the form of a rotary valve is arranged in the heavy material shaft 14 in order to adjust the discharge rate of the heavy material.

It is proposed to arrange a pressure measuring device 8 within the air funnel 3 underneath the jigging material carrier 2 in order to measure the pressure underneath the jigging material carrier 2. It was found that the measured pressure increases proportionally to the height of the heavy material layer 5 such that the height of the heavy material layer 5 can be determined based on the measured pressure and this value can also be used for adjusting the discharge adjusting device 9 in the course of a control process.

LIST OF REFERENCE SYMBOLS

1 Material feeding device
2 Jigging material carrier
3 Air funnel
4 Working air
5 Heavy material layer
6 Light material layer
7 Discharge device
8 Pressure measuring device
9 Discharge adjusting device
10 Infeed adjusting device
11 Fan
12 Valve
13 Light material overflow
14 Heavy material shaft

The invention claimed is:

1. An air jigging machine for the dry processing of raw materials, comprising at least one material feeding device (1), at least one jigging material carrier (2) that is provided with openings, an air funnel (3) that is arranged underneath the jigging material carrier (2) and by means of which an air flow can be fed to the jigging material carrier as working air (4), which is composed of a constant partial flow and a superimposed pulsating partial flow, such that the working air (4) can flow through the material fed onto the jigging material carrier (2) and said material can be stratified into a heavy material layer (5) acting as a jig bed and a light material layer (6) lying thereon, as well as a discharge device (7) for the heavy material and light material stratified on the jigging material carrier (2) during the jigging process, characterized in that a pressure measuring device (8) for determining the pressure differential between the pressure in the air funnel (3) and the surroundings is arranged upstream to the jigging material carrier (2), and in that a control unit for adjusting the material throughput is provided, wherein the measured pressure differential is used for adjusting the material throughput.

2. The air jigging machine according to claim 1, wherein the discharge device (7) has a discharge adjusting device (9) for the heavy material and the discharge adjusting device (9) is adjusted in dependence on the measured pressure differential.

3. The air jigging machine according to claim 1, wherein the material feeding device (1) has an infeed adjusting device (10) and the infeed adjusting device (10) is adjusted in dependence on the measured pressure differential.

4. The air jigging machine according to claim 1, wherein a fan (11) and/or a valve (12) for adjusting the air flow is connected to the air funnel, and wherein the fan (11) and/or the valve (12) is adjusted in dependence on the measured pressure differential.

5. The air jigging machine according to claim 1, wherein the jigging material carrier (2) can be subjected to vibrations by means of an associated drive.

6. A method for operating an air jigging machine according to claim 1, comprising at least the following steps:

feeding material comprising light material and heavy material onto at least one jigging material carrier (2) that is provided with openings, causing an air flow to flow through the material fed onto the jigging material carrier (2) as working air (4), which is composed of a constant partial flow and a superimposed pulsating partial flow, such that the supplied material is stratified into a heavy material layer (5) acting as a jig bed and a light material layer (6) lying thereon, and discharging the stratified heavy material and the stratified light material, characterized in that a pressure is determined upstream to the jigging material carrier (2), and in that the infeed and/or the discharge is adjusted in dependence on the determined pressure.

7. The method according to claim 6, wherein a discharge adjusting device (9) for the heavy material is adjusted in dependence on the measured pressure.

8. The method according to claim 6, wherein an infeed adjusting device (10) is adjusted in dependence on the measured pressure.

9. The method according to claim 6, wherein a fan (11) and/or a valve (12) is adjusted in dependence on the measured pressure.

10. The method according to claim 6, wherein the measured pressure is used for calibrating the air flow in that the air flow is changed between a first air flow and a second air flow while the jigging material carrier (2) is completely filled and the thusly measured pressure is used for adjusting an operating point of the working air, wherein the first air flow is lower than the second air flow.

* * * * *